United States Patent [19]

Kissinger

[11] Patent Number: 4,928,343

[45] Date of Patent: May 29, 1990

[54] SCOURING PAD TOOL

[76] Inventor: Mark R. Kissinger, 1374 Buckwood La., Monument, Colo. 80132

[21] Appl. No.: 264,367

[22] Filed: Oct. 31, 1988

[51] Int. Cl.[5] ..... A47L 17/08; A47L 13/04

[52] U.S. Cl. ..... 15/209 D; 15/152; 15/177; 51/392

[58] Field of Search ..... 15/151-153, 15/147 R, 147 C, 176.1, 177, 209 D, 209 B, 210 R, 228, 244.1; 51/391, 392, 393

[56] References Cited

U.S. PATENT DOCUMENTS

| | | | |
|---|---|---|---|
| 798,134 | 8/1905 | Kelley et al. | 15/151 |
| 1,575,554 | 3/1926 | Dufloth | 51/392 |
| 1,855,635 | 4/1932 | Kelley | 51/392 |
| 2,400,929 | 5/1946 | Hein | 51/392 |
| 3,388,415 | 6/1968 | Warner et al. | 15/210 R X |

*Primary Examiner*—Edward L. Roberts
*Attorney, Agent, or Firm*—Richard W. Hanes

[57] ABSTRACT

A holding implement for a flexible pad comprises an elongated handle forming a shaft and a pad mounting shoe having upturned side members is mounted on the shaft. One of the side members has an aperture therein and is attached to the shaft. A second of the side members has an overturned edge which forms a pad gripping portion. A pad clamping element is slidably carried by the shaft to engage a pad disposed against the handle facing surface of the side member attached to the shaft. The clamping element includes at least one tooth projection sized to extend into the aperture when the clamping element is moved toward the first side member.

3 Claims, 2 Drawing Sheets

264367

SCOURING PAD TOOL

BACKGROUND

Scouring pads made of steel wool, plastic or other coarse materials have been in use for a long period of time but they conventionally require hand holding. This becomes a disadvantage when cleaning is to be done in very hot, soapy water, or with a solution that may irritate skin, or in the presence of hot stove, oven or griddle elements. It is therefore the object of this invention to provide a holding implement for scouring pads which will eliminate the disadvantages of maneuvering the pad by hand while at the same time bringing to the cleaning problem certain advantageous features not present with digital manipulation.

One such advantage is backing the pad with a flat, rigid mount so that when cleaning flat surfaces uniform pressure will be exerted by the pad over its contact area as opposed to small areas of high pressure represented by the finger tips.

A second advantage of the tool as a pad holder is the provision of at least three different angles around which the pad is wrapped so as to enable the pad to fit snugly into the various angles of cooking devices to provide cleansing action to all areas and corners of the object being scrubbed.

An additional and further object of the holding tool of the present invention is to provide a holder for a flexible scouring pad which can mount and dismount the pad with ease and simplicity while at the same time provide a secure attachment for the pad which will not allow it to loosen during use.

DETAILED DESCRIPTION

Figure 1:
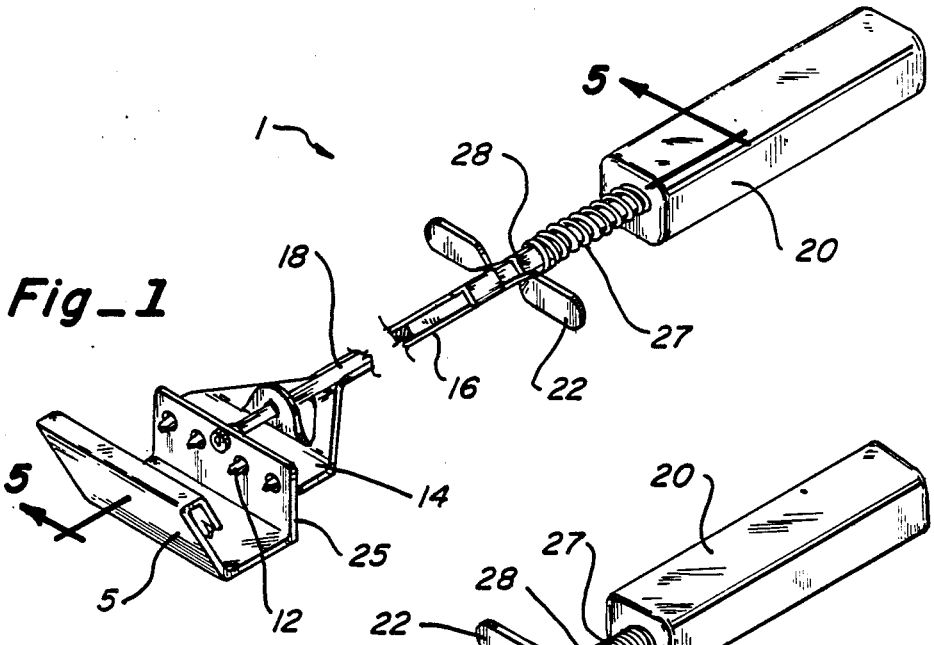
FIG. 1 is a fragmentary rearward looking perspective view of the tool of the present invention.
Figure 2:
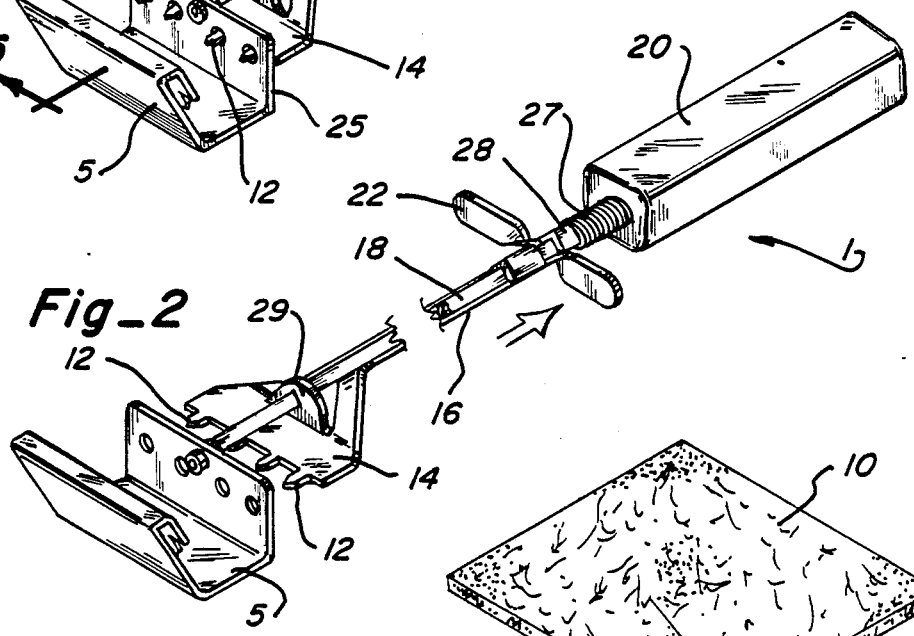
FIG. 2 is a fragmentary rearward looking perspective view of the tool of the present invention showing the teeth-carrying plunger plate and sleeve in retracted position.
Figure 4:
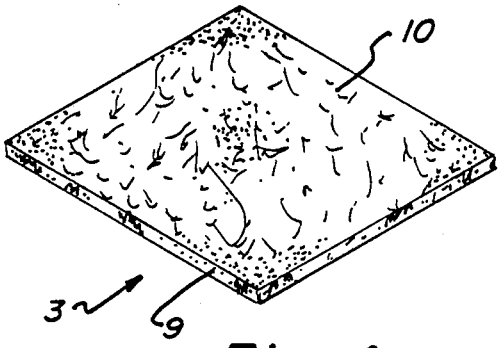
FIG. 4 is a perspective view of a typical scouring pad to be mounted on the tool.
Figure 8:
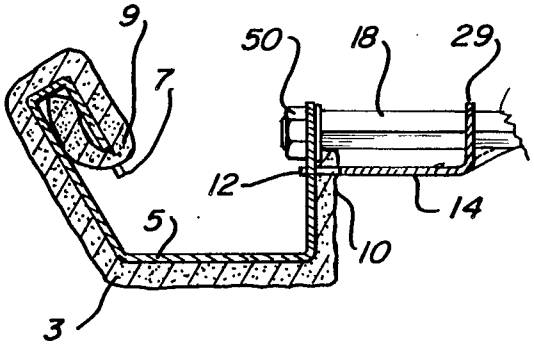
FIG. 8 is a fragmentary cross-sectional view taken along lines 8—8 of FIG. 7.
Figure 7:
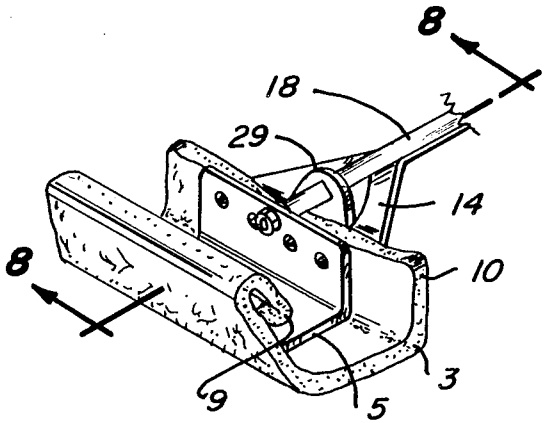
FIG. 7 is a fragmentary rearward looking perspective view of the head of the implement showing a scouring pad in mounted position.

The scouring pad holding tool of the present invention is shown generally in FIGS. 1 and 2 and shall be identified with reference numeral 1. A typical scouring pad 3 is seen in FIG. 4. FIGS. 7 and 8 illustrate the pad 3 as mounted on the mounting plate 5 of the tool 1.

As can be seen, the pad 5 is wrapped around the mounting plate 5 and held in mounted position by two sets of teeth which penetrate the pad along its forward and rearward edges. The first set of teeth 7 are formed integrally with the top downturned lip 8 of the plate 5. In mounting the pad on the plate these teeth 7 are made to first engage and penetrate the forward edge 9 of the pad 5 and then, having secured the pad to the lip 8, the pad is wrapped around the plate 5 and the rear edge 10 of the pad 5 is engaged by the second set of teeth 12 to hold the pad firmly in place.

The teeth 12 are integrally formed on the leading edge of a plunger plate 14 which is constructed as a forward extension of a sleeve 16 slideable on the elongated shaft 18 of the handle 20 of the tool.

Figure 3:
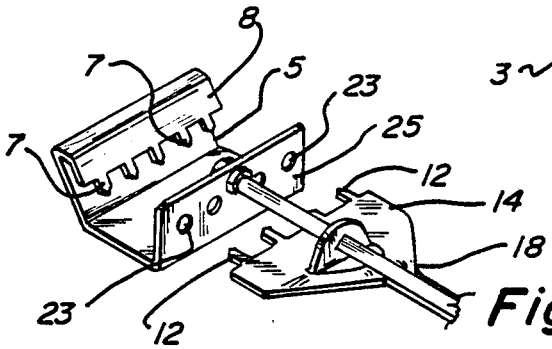
FIG. 3 is a fragmentary forward looking perspective view of the head of the tool of the present invention.
Figure 6:
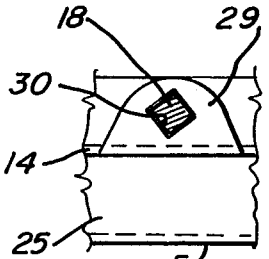
FIG. 6 is a fragmentary cross-sectional view of the tool taken along lines 6—6 of FIG. 5.
Figure 5:
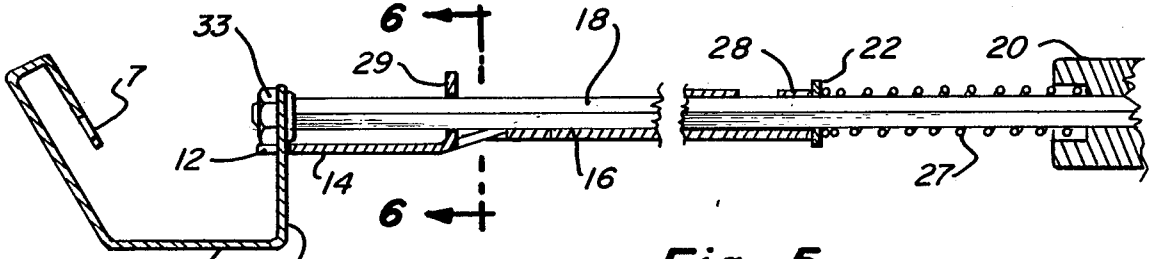
FIG. 5 is a fragmentary cross-sectional view of the tool taken along lines 5—5 of FIG. 1.

Rearwardly of the sleeve 16, toward the handle 20, a pair of opposing ears 22 protrude perpendicularly from the sleeve and shaft and act as finger supports for manual force needed to move the sleeve in a rearward direction to retract the teeth 12 from aligned apertures 23 in the mounting plate 5 and provide sufficient space between the back face 25 of the plate 5 and the teeth 12 to insert the rearward edge 10 of the pad 3 when mounting the pad. A helical spring 27 surrounds the handle shaft 18 and is disposed between the handle 20 and an annular collar 28 fixed to the rearward end of the sleeve 16. The spring 27 is sized and disposed so as to be compressed (FIGS. 2 and 3) when the sleeve is moved rearwardly to retract the teeth 12 and to provide a biasing force to the sleeve that will clamp the edge 10 of the pad by thrusting the teeth through the pad 3 and into the apertures 23 upon release of the rearward pressure on the ears 22 (FIGS. 1, 5, 7 and 8).

A stabilizing bracket 29 is attached to the plunger plate 14. An aperture 30 in the bracket is sized to receive the shaft 18 and permit its easy sliding movement within the aperture while at the same time providing stability for the plunger plate 14.

The handle shaft 18 is attached to the back face 25 of the plate 5 by a nut 33 threaded to the end of the shaft 18 which passes through the back face 25.

I claim:

1. A holding implement for a flexible pad comprising in combination:

an elongated handle forming shaft;

a pad mounting shoe having upturned side members, the first of which side members is attached to the shaft and contains at least one aperture and the second of which side members has an overturned edge forming pad gripping means;

reciprocally movable pad clamping means slidably carried by the shaft to engage a pad disposed against the handle facing surface of the first side member where the pad clamping means includes at least one tooth projection sized and positioned to be introduced into the said aperture when the pad clamping means is moved toward the said first side member.

2. The implement of claim 1, wherein the pad clamping means further comprises a longitudinal sleeve surrounding the shaft and having laterally extending handle means attached thereto.

3. The combination of claim 2 and further including biasing means engaging the said sleeve providing pressure to move the sleeve longitudinally of the shaft toward the first side member.

* * * * *